US009654239B2

(12) United States Patent
Mittal et al.

(10) Patent No.: US 9,654,239 B2
(45) **Date of Patent: *May 16, 2017**

(54) METHODS AND APPARATUS FOR ENABLING CONTEXT SENSITIVE INTERACTION WITH DISTRIBUTED CONTENT

(71) Applicant: QUALCOMM Incorporated, San Diego, CA (US)

(72) Inventors: Vineet Mittal, San Diego, CA (US); Rajeev Rajan, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/151,256

(22) Filed: May 10, 2016

(65) Prior Publication Data

US 2016/0254873 A1 Sep. 1, 2016

Related U.S. Application Data

(63) Continuation of application No. 12/535,557, filed on Aug. 4, 2009, now Pat. No. 9,397,773.

(Continued)

(51) Int. Cl.
*H04H 60/37* (2008.01)
*H04H 20/00* (2009.01)

(Continued)

(52) U.S. Cl.
CPC ..... *H04H 60/37* (2013.01); *H04H 20/00* (2013.01); *H04H 60/47* (2013.01); *H04H 60/63* (2013.01);

(Continued)

(58) Field of Classification Search
USPC ..... 455/3.01
See application file for complete search history.

(56) References Cited

U.S. PATENT DOCUMENTS 5,220,682 A * 6/1993 Tomohiro ..... H03J 1/0066 455/161.2
9,397,773 B2 7/2016 Mittal et al.

(Continued)

FOREIGN PATENT DOCUMENTS

CN 1918832 A 2/2007
JP 10135855 A 5/1998

(Continued)

OTHER PUBLICATIONS

Berger P, et al., "Compression of EMG signals with wavelet transform and artificial neural networks; Compression of EMG signals", Physiological Measurement, Institute of Physics Publishing, Bristol, GB, vol. 27, No. 6, Jun. 1, 2006 (Jun. 1, 2006), pp. 457-465, XP020105778, ISSN: 0967-3334, DOI: DOI:10.1088/0967-3334/27/6/003.

(Continued)

*Primary Examiner* — Ankur Jain
(74) *Attorney, Agent, or Firm* — Toler Law Group, PC

(57) ABSTRACT

A method includes receiving a distributed radio signal at a wireless communications device (WCD) from a first service provider. The method includes generating a bookmark associated with a first content item included in the distributed radio signal. The bookmark is generated based on radio application data when the WCD is radio-enabled, and the bookmark is generated based on pseudo-radio application data when the WCD is not radio-enabled. The method also includes transmitting the bookmark and a content request associated with the first content item from the WCD to a content source.

30 Claims, 8 Drawing Sheets

Related U.S. Application Data

(60) Provisional application No. 61/168,324, filed on Apr. 10, 2009.

(51) Int. Cl.

| | |
|---|---|
| ***H04H 60/63*** | (2008.01) |
| ***H04H 60/85*** | (2008.01) |
| ***H04H 60/47*** | (2008.01) |
| *H04H 20/28* | (2008.01) |
| *H04H 60/80* | (2008.01) |

(52) U.S. Cl.

CPC ..... *H04H 60/85* (2013.01); *H04H 20/28* (2013.01); *H04H 60/80* (2013.01); *H04H 2201/13* (2013.01); *H04H 2201/37* (2013.01)

(56) References Cited

U.S. PATENT DOCUMENTS

| | | | | |
|---|---|---|---|---|
| 2002/0049037 | A1* | 4/2002 | Christensen | G06Q 30/0267 455/3.06 |
| 2005/0176366 | A1* | 8/2005 | Levy | H04H 20/72 455/3.06 |
| 2005/0239495 | A1* | 10/2005 | Bayne | G06Q 30/02 455/550.1 |
| 2007/0211699 | A1* | 9/2007 | Thompson | H04L 1/1642 370/353 |

FOREIGN PATENT DOCUMENTS

| | | | |
|---|---|---|---|
| JP | 11055201 | A | 2/1999 |
| JP | 2002101059 | A | 4/2002 |
| JP | 2003092556 | A | 3/2003 |
| JP | 2003101496 | A | 4/2003 |
| JP | 2004509509 | A | 3/2004 |
| JP | 2005523661 | A | 8/2005 |
| JP | 2005523665 | A | 8/2005 |
| JP | 2006508594 | A | 3/2006 |
| JP | 2006508619 | A | 3/2006 |
| JP | 2008526103 | A | 7/2008 |
| JP | 4171962 | B2 | 10/2008 |
| JP | 2009009204 | A | 1/2009 |
| KR | 100874858 | B1 | 12/2008 |
| WO | 0223773 | A2 | 3/2002 |
| WO | 03090480 | A1 | 10/2003 |
| WO | 03090484 | A1 | 10/2003 |
| WO | 2004051885 | A1 | 6/2004 |
| WO | 2004055999 | A1 | 7/2004 |
| WO | 2006071273 | A1 | 7/2006 |

OTHER PUBLICATIONS

International Preliminary Report on Patentability—PCT/US2010/030771, The International Bureau of WIPO—Geneva, Switzerland, Jul. 12, 2011.

International Search Report and Written Opinion—PCT/US2010/030771—ISA/EPO, Jun. 14, 2010.

Taiwan Search Report—TW099111123—TIPO—Nov. 3, 2013.

* cited by examiner

METHODS AND APPARATUS FOR ENABLING CONTEXT SENSITIVE INTERACTION WITH DISTRIBUTED CONTENT

PRIORITY CLAIM

This application claims priority from, and is a continuation application of, U.S. patent application Ser. No. 12/535,557, filed on Aug. 4, 2009, and claims priority to U.S. Provisional Patent Application No. 61/168,324, filed on Apr. 10, 2009, the contents of which are expressly incorporated herein by reference in their entireties.

BACKGROUND

Field

The disclosed aspects relate to context sensitive interactions between a content distributor and a wireless communications device over one or more networks.

Background

Broadcast radio stations, such as FM radio stations, may use a system known as a Radio Data System (RDS) or Radio Broadcast Data System (RBDS), both referred to herein as "RDS," to transmit supplemental information corresponding to their normal radio programming, e.g. music, talk, news, etc. RDS provides a standard protocol for several types of supplemental information transmitted by the broadcast radio stations, such as the identity of the particular radio station, the type of programming, and text information such as the name of an artist and/or song.

For example, broadcast radio stations transmit their programming and the supplemental information in the RDS format as distinct signals multiplexed onto a single carrier. Radio receivers having RDS decoders, such as those included with some wireless communications devices or those in a vehicle, permit a user to listen to the transmitted programming and view the corresponding supplemental information on a display.

Currently, some mobile operators may not include proper resources for supporting interactive FM RDS service. Additionally, mobile operators may not include proper resources for supporting back-end database integration that would allow mobile users to interact with information available to FM RMS enabled devices. Thus, improved apparatus and methods for providing interactivity between non-FM RDS enabled mobile devices and mobile operators to allow access to RDS related content are desired.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

In accordance with one or more aspects and corresponding disclosure thereof, various aspects are described in connection with obtaining distributed content by a wireless communications device. According to one aspect, a method for obtaining distributed content by a wireless communications device is provided. The method may include receiving, by a wireless communications device (WCD), a first content item distributed by a first service provider. Further, the method may include obtaining a bookmark, wherein the bookmark couples at least one WCD operation identifying item to the first content item. Additionally, the method may include transmitting, from the WCD, to a second service provider, a content item request coupled to the bookmark. Moreover, the method may include receiving, from the second service provider, a second content item associated with the first content item through the transmitted content item request and the bookmark.

Yet another aspect relates to at least one processor configured to obtain content distributed to a wireless communications device. The processor may include a first module for receiving, by a wireless communications device (WCD), a content item distributed by a first service provider. Further the processor may include a second module for obtaining a bookmark, wherein the bookmark couples at least one WCD operation identifying item to the first content item. Additionally, the processor may include a third module for transmitting, from the WCD, to a second service provider, a content item request coupled to the bookmark. Moreover, the processor may include a fourth module for receiving, from the second service provider, a second content item associated with the first content item through the transmitted content item request and the bookmark.

Still another aspect relates to a computer program product comprising a computer-readable medium. The computer program product may include a computer-readable medium including a first set of codes for causing a computer to receive, by a wireless communications device (WCD), a first content item distributed by a first service provider. The computer program product may further include a computer-readable medium including a second set of codes for causing the computer to generate, by the WCD, a bookmark, wherein the bookmark couples at least one WCD operation identifying item to the first content item. The computer program product may still further include a computer-readable medium including a third set of codes for causing the computer to transmit, from the WCD, to a second service provider, a content item request coupled to the bookmark. Additionally, the computer program product may include a computer-readable medium including a fourth set of codes for causing the computer to receive, from the second service provider, a second content item associated with the first content item through the transmitted content item request and the bookmark.

Yet another aspect relates to an apparatus. The apparatus may include means for receiving, by a wireless communications device (WCD), a content item distributed by a first service provider. The apparatus may further include means for obtaining a bookmark, wherein the bookmark couples at least one WCD operation identifying item to the first content item. Additionally, the apparatus may include means for transmitting, from the WCD, to a second service provider, a content item request coupled to the bookmark. Moreover, the apparatus may include means for receiving, from the second service provider, a second content item associated with the first content item through the transmitted content item request and the bookmark.

Another aspect relates to an apparatus. The apparatus may include a receiver for receiving, by a wireless communications device (WCD), a first content item distributed by a first service provider. Further, the apparatus may include a content module for obtaining a bookmark, wherein the bookmark couples at least one WCD operation identifying item to the first content item. Additionally, the apparatus may include a transmitter for transmitting, from the WCD, to a second service provider, a content item request coupled to the bookmark. Moreover the receiver may be further operable for receiving, from the second service provider, a second content item associated with the first content item through the transmitted content item request and the bookmark.

Furthermore, in accordance with one or more aspects and corresponding disclosure thereof, various aspects are described in connection with facilitating distribution of content to a wireless communications device. According to one aspect, a method for facilitating distribution of content to a wireless communications device is provided. The method may include receiving, from a first service provider, a first content item distributed by the first service provider. Further, the method may include receiving, from a wireless communications device (WCD), a content item request, wherein the request includes a bookmark coupling at least one WCD operation identifying item to the first content item. Still further, the method may include determining if the content item is available by processing the first content item with the bookmark received from the WCD. Additionally, the method may include obtaining a second content item, wherein the second content item is associated with the first content item through the transmitted content item request and the bookmark upon a determination that the content item is available. Moreover, the method may include transmitting the obtained second content item to the requesting WCD.

Yet another aspect relates to at least one processor configured to facilitate distribution of content to a wireless communications device. The processor may include a first module for receiving, from a first service provider, a first content item distributed by the first service provider. Further, the processor may include a second module for receiving, from a wireless communications device (WCD), a content item request, wherein the request includes a bookmark coupling at least one WCD operation identifying item to the first content item. Still further, the processor may include a third module for determining if the content item is available by processing the first content item with the bookmark received from the WCD. Additionally, the processor may include a fourth module for obtaining the content item upon a determination that a second content item is available, wherein the second content item is associated with the first content item through the transmitted content item request and the bookmark. Moreover, the processor may include a fifth module for transmitting the obtained second content item to the requesting WCD.

Still another aspect relates to a computer program product comprising a computer-readable medium. The computer program product may include a computer-readable medium including a first set of codes for causing a computer to, from a first service provider, a first content item distributed by the first service provider. The computer program product may also include a computer-readable medium including a second set of codes for causing the computer to receive, from a wireless communications device (WCD), a content item request, wherein the request includes a bookmark coupling at least one WCD operation identifying item to the first content item. The computer program product may further include a computer-readable medium including a third set of codes for causing the computer to determine if the content item is available by processing the first content item with the bookmark received from the WCD. The computer program product may still further include a computer-readable medium including a fourth set of codes for causing the computer to obtain the content item upon a determination that a second content item is available, wherein the second content item is associated with the first content item through the transmitted content item request and the bookmark. Additionally, the computer program product may include a computer-readable medium including a fifth set of codes for causing the computer to transmit the obtained second content item to the requesting WCD.

Yet another aspect relates to an apparatus. The apparatus may include means for receiving, from a first service provider, a first content item distributed by the first service provider. The apparatus may further include means for receiving, from a wireless communications device (WCD), a content item request, wherein the request includes a bookmark coupling at least one WCD operation identifying item to the first content item. The apparatus may still further include means for determining if the content item is available by processing the first content item with the bookmark received from the WCD. Additionally, the apparatus may include means for obtaining a second content item upon a determination that the content item is available, wherein the second content item is associated with the first content item through the transmitted content item request and the bookmark. Moreover, means for transmitting the obtained second content item to the requesting WCD.

Another aspect relates to an apparatus. The apparatus may include a receiver for: receiving, from a first service provider, a first content item distributed by the first service provider using a first format, and receiving, from a wireless communications device (WCD), a content item request, wherein the request includes a bookmark coupling at least one WCD operation identifying item to the first content item. The apparatus may further include a content module for: determining if the content item is available by processing the first content item with the bookmark received from the WCD, and obtaining a second content item upon a determination that the content item is available, wherein the second content item is associated with the first content item through the transmitted content item request and the bookmark. Moreover, the apparatus may include a transmitter for transmitting the obtained second content item to the requesting WCD.

To the accomplishment of the foregoing and related ends, the one or more aspects comprise the features hereinafter fully described and particularly pointed out in the claims. The following description and the annexed drawings set forth in detail certain illustrative features of the one or more aspects. These features are indicative, however, of but a few of the various ways in which the principles of various aspects may be employed, and this description is intended to include all such aspects and their equivalents.

BRIEF DESCRIPTION OF THE DRAWINGS

The disclosed aspects will hereinafter be described in conjunction with the appended drawings, provided to illustrate and not to limit the disclosed aspects, wherein like designations denote like elements, and in which.

DETAILED DESCRIPTION

Various aspects are now described with reference to the drawings. In the following description, for purposes of explanation, numerous specific details are set forth in order to provide a thorough understanding of one or more aspects. It may be evident, however, that such aspect(s) may be practiced without these specific details.

The ability to access secondary and/or context related content associated with primary content distributed by a first service provider to a device that may be unable to directly access the secondary and/or content related content may be accomplished through using interactivity between the device and a second service provider, wherein the second service provider is capable of processing the secondary and/or context content. In particular, the present aspects enable a wireless device to receive a radio signal, such as an FM signal, and access secondary content associated with the radio signal, such as FM RDS data, through a second service provider, such as a cellular network service provider, internet service provider, etc., without requiring the device to be able to directly access the secondary content.

Figure 1:
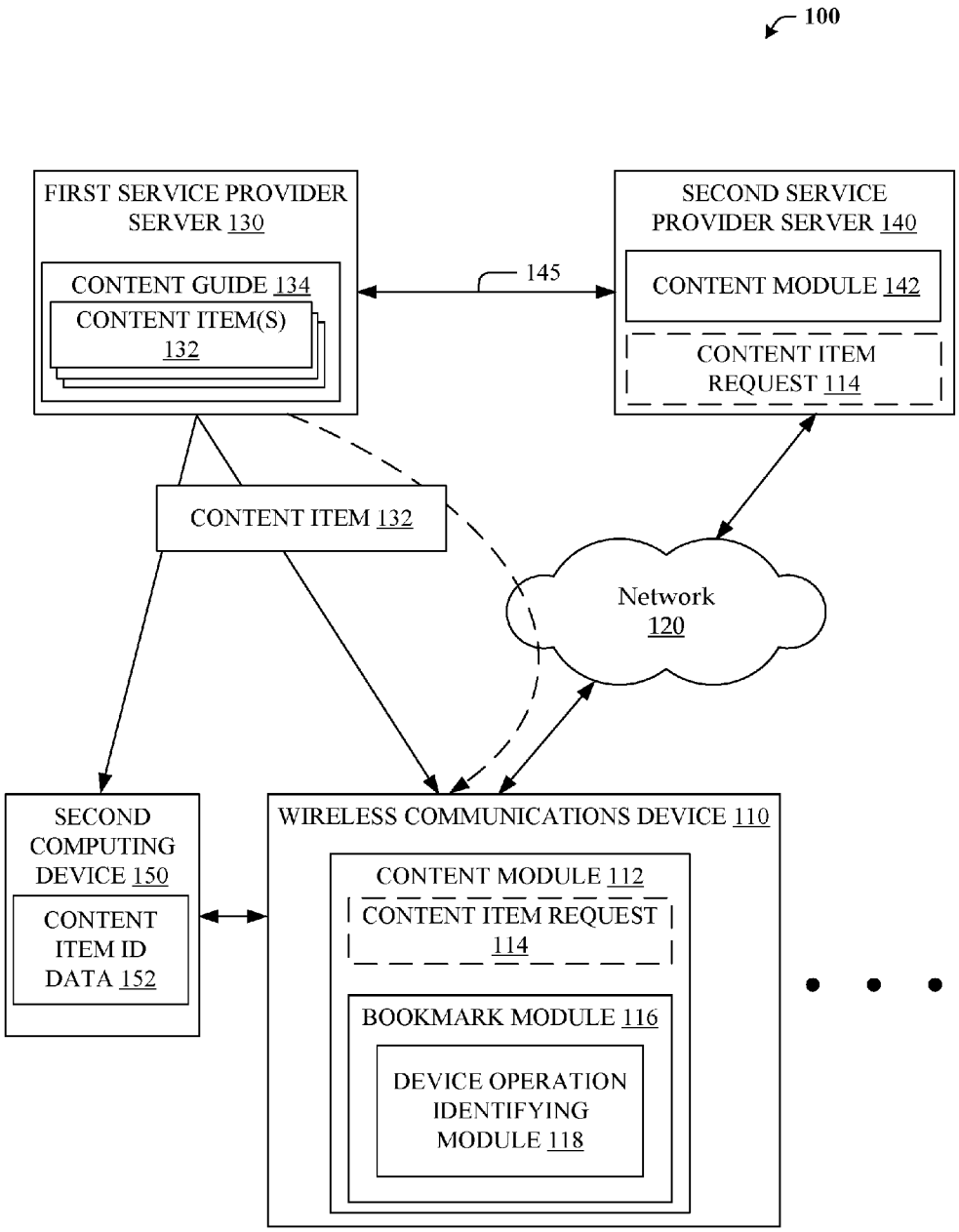
FIG. 1 illustrates a block diagram of a communication network according to an aspect.

With reference to FIG. 1, a block diagram of a communication network 100 according to an aspect is illustrated. Communication network 100 may include one or more of wireless communications devices 110 (FIG. 1 depicts an ellipsis next to communications device 110 as a representation of a possible plurality of devices not shown) connected to a communication network 120, e.g., a CDMA network, a GPRS network, a UMTS network, IP network, FM based network, AM based network, satellite radio network, and other types or combinations of types of communication networks. Communication network 100 may further include a plurality of servers 130, 140 connected to one or more communication networks 120. In one aspect, the plurality of servers includes first service provider server 130 and second service provider server 140. In one exemplary aspect, server 130 may communicate content item 132 to wireless communications device 110 via a FM based network, while server 140 may communicate with wireless communications device 110 via a CDMA network, IP network, etc. In another aspect, additionally or in the alternative, content item 132 may be communicated (e.g. streamed) to wireless communications device 110 via a CDMA network, IP network, etc. In one aspect, wireless communications device 110 may further include a content module 112. Further, content module 110 may include bookmark module 116 and device operation identifying module 118.

In one aspect, communication network 100 may further include second computing device 150. In such an aspect, second computing device 150 may be communicatively coupled to wireless communications device 110 and further may be able to receive content item identifying data 152. For example, second computing device 150 may include a personal navigation device (PND) capable of receiving FM RDS data which may accompany distribution of content item 132 by first service provider server 130. In such an exemplary aspect, second computing device 150 may further assist wireless communications device in identifying a distributed content item 132 through content item identifying data 152 to generate a content item request 114. In another exemplary aspect, second computing device 150 may include computer with network access, such as internet access, to allow second computing device 150 to retrieve content item identifying data 152 from a website, or the like, associated with first service provider server 130. In such an exemplary aspect, second computing device 150 may further assist wireless communications device in identifying a distributed content item 132 through content item identifying data 152 to generate a content item request 114.

In operation, wireless communication device 110 may receive a content item 132 signal distributed by first service provider 130. In such an aspect, the first service provider may: broadcast, multicast, and/or unicast content item 132. In one aspect, distributed content may include data (e.g. FM RDS data) associated with the content. Further, in such an aspect, the wireless communications device 110 may not be enabled to receive the accompanying FM RDS data. Further, in one aspect, first service provider 130 may distribute content item 132 using a format such as but not limited to: a frequency modulation (FM) format, an amplitude modulation (AM) format, a satellite radio format, an internet protocol (IP) format, an HD radio format, an XM radio format. Still further, in operation, content module 112 may generate a content item request 114 to obtain access to a content item 132, or a version thereof, distributed by first service provider server 130. Further, in one aspect, to assist in identifying and obtaining the requested content item 132, bookmark module 116 may couple at least one device operation identifying items 118 to the content item request. Additionally, or in the alternative, in one aspect, bookmark module 116 may receive a bookmark from another device, such second computing device, coupling the at least one device operation identifying items 118 to the content item request. In one aspect, device operation identifying items may include at least one of: an audio clip capture of the content item 132, a WCD 110 location identifier, a timestamp, a user inputted content item tag, at least a portion of metadata received with the content item 132, radio data system (RDS) information for the content item 132, or information obtained from a content guide 134 for the content item 132. In one aspect, bookmark module 116 may generate a bookmark that includes at least one of: data linked to the first content item, data defining the first content item, or a link to the first content item. In such an aspect, the link to the first content item may further include an active link to the first content item to allow the bookmark to be updated at a predetermined interval of time, such as periodically, upon a user selection, etc. In another aspect, bookmark module may generate a bookmark for content guide 134. In one aspect, upon generating content item request 114, wireless communications device 110 may transmit the content item request 114 to second service provider server 140 via network 120. In one aspect, For example, the request may be transmitted over a network using a protocol such as: CDMA, WCDMA, TDMA, TD-SCDMA, UMTS, IP GSM, LTE, WiMax, WiFi, UMB, EV-DO, etc.

Further, in operation, second service provider server 140 may receive content item request 114 coupled to bookmark information. Second service provider server 140 may be communicatively coupled to first service provider server 130 via a wired or wireless connection 145. As such, in one aspect, second service provider server 140 may process content item request 114 and any device operation identifying items to determine the content item 132 requested in content item request 114. For example, content item 132 may include but is not limited to any of: music, pictures, talk shows, blogs, contests, interactive voice response (IVR) calls, news articles, videos, wallpaper, etc. or any combination thereof. Thereafter, second service provider server 140 may attempt to obtain the identified content item 132. In one aspect, if the content item 132 may be obtained, then a version of content item 132 may be transmitted to wireless communications device. In such an aspect, the audio content item may be obtained with a format such as but not limited to: a .wav file format, or an .aac file format, or a .qcp file format, a MP3 file format, etc. Further, a visual content item, such as a picture, wallpaper, etc. may be obtained with a format such as but not limited to: a jpeg format, a .gif format, a .tiff format, a .bmp format etc. Thereafter, the obtained content item may be transmitted to wireless communications device 110 for storage, access, etc.

Accordingly, wireless communications device 110 may obtain content item 132 that was distributed by a first service provider 130 by providing data identifying the wireless communications device 110 sufficiently to allow a second service provider 140 to identify the requested content item 132.

Figure 2:
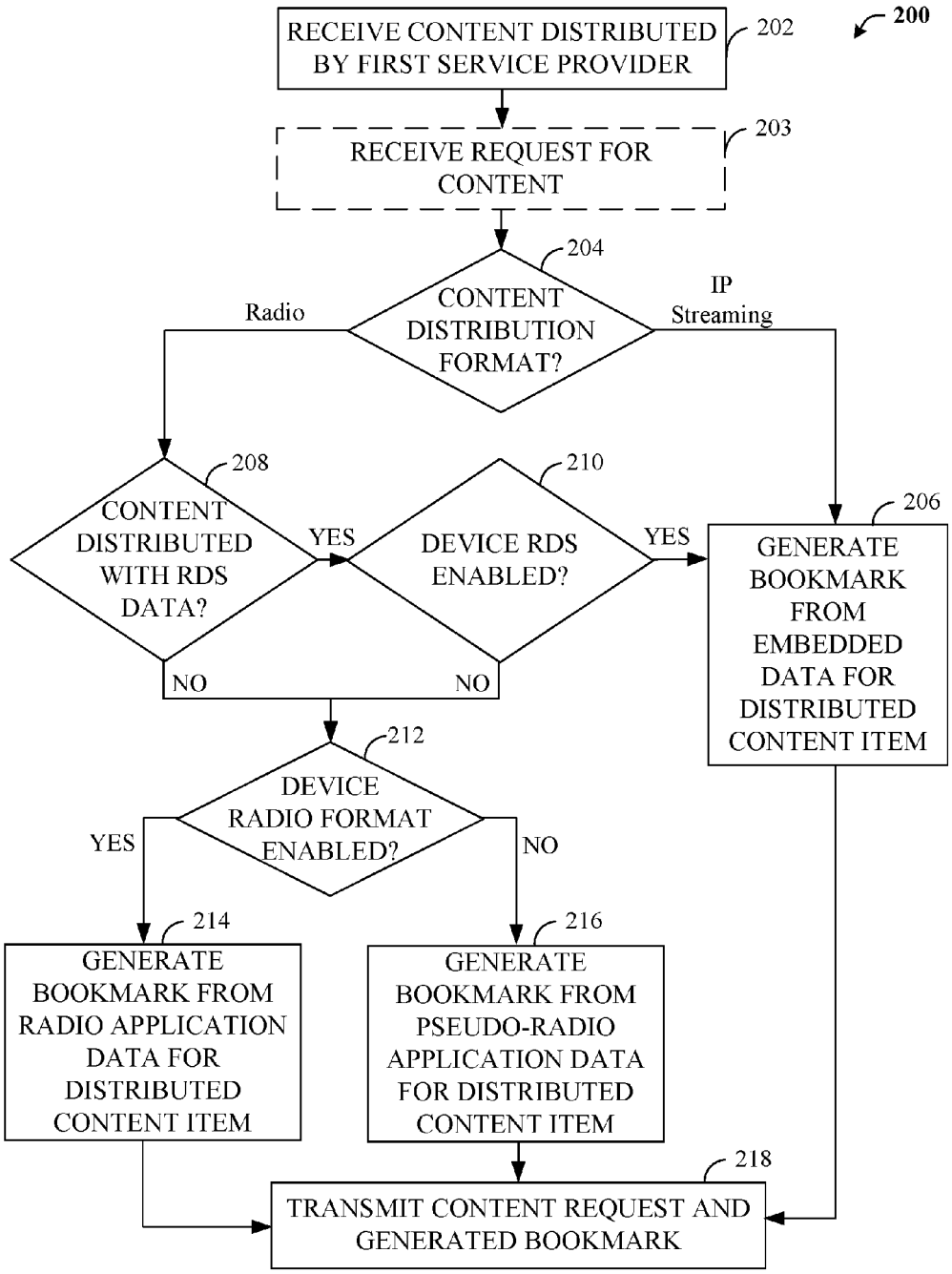
FIG. 2 is a flowchart of an aspect of an overview of a communication network content distribution process.

FIG. 2 illustrates various methodologies in accordance with the claimed subject matter. While, for purposes of simplicity of explanation, the methodologies are shown and described as a series of acts, it is to be understood and appreciated that the claimed subject matter is not limited by the order of acts, as some acts may occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with the claimed subject matter. Additionally, it should be further appreciated that the methodologies disclosed hereinafter and throughout this specification are capable of being stored on an article of manufacture to facilitate transporting and transferring such methodologies to computers. The term article of manufacture, as used herein, is intended to encompass a computer program accessible from any computer-readable device, carrier, or media.

Referring to FIG. 2, at reference numeral 202, a content item, distributed by a first service provider, may be received. In one aspect, the content item may be distributed using a format such as: a frequency modulation (FM) format, an amplitude modulation (AM) format, a satellite radio format, an internet protocol (IP) format, etc. For example, a user may hear a song transmitted from an FM radio station. In such an exemplary aspect, the user may be listening to the radio through the wireless device, the user may be listening to the radio through a device communicatively coupled to the wireless device, and/or the user may be listening to the radio through a device which is not communicatively coupled to the wireless device, but where the wireless device is accessible to the user. In one aspect, at reference numeral 203, a request may be received to obtain the content item distributed by the first service provider. For example, if a user is listening on the wireless device, a prompt may be present and selected which allows the user to request that the song be obtained. In another example, if the user is listening to a second device communicatively coupled to the wireless communications device, the user may make a selection on the second device to request that the song be obtained and such a request may be communicated to the wireless communication device. In still another example, a user a make a selection through a wireless device which is not operable to receive a signal from the first service provider. In such an exemplary aspect, the wireless communications device may use a pseudo-radio application, or the like, to allow the user to make a selection and to further obtain sufficient information to allow the wireless device to subsequently identify the requested content item.

At reference numeral 204, a determination is made as to whether the content from the first service provider was distributed via a radio format, such as FM, AM, satellite radio, etc., or if the content was streamed via an IP format. Upon a determination that the content was distributed with an IP format, then at reference numeral 206, a bookmark may be generated from contextual information associated with the streamed and requested content item. In one example, the streamed content may include contextual data coupled to each content item. In another example, a content guide may be obtained which provides contextual information for at least a portion of content items distributed by the first service provider. In one aspect, additional user and/or wireless communications device information may be added to the bookmark to further identify the requested content item, the user, and/or the device. For example, device operation identifying data, such as but not limited to: an audio clip capture of a content item, a WCD location identifier, a timestamp, a user inputted content item tag, at least a portion of metadata received with a content item, radio data system (RDS) information for a content item, or information obtained from a content guide for a content item, etc. may be obtained and added to the bookmark.

Upon a determination that the content item was distributed via a radio format, at reference numeral 208, a determination may be made as to whether the requested content item was transmitted with any accompanying contextual information to facilitate identification of the requested content item. For example, a content item may be distributed using an FM format with accompanying contextual information, such as FM RDS data, which may specifically identify the content item with which it is distributed.

Upon a determination that the content item was distributed with accompanying contextual information, such as FM RDS, at reference numeral 210, a determination is made as to whether the contextual information may be obtained. For example, the requesting wireless communications device may be FM RDS enabled or a device communicatively coupled to the wireless communications device may be FM RDS enabled thereby allowing the accompanying contextual information to be obtained. If it is determined that the accompanying contextual information may be obtained at reference numeral 210, then a bookmark is generated including the accompanying contextual information, such as described above, at reference numeral 206. In one aspect, additional user and/or wireless communications device information may be added to the bookmark to further identify the requested content item, the user, or the device.

If either the content item was not distributed with accompanying contextual information or the requesting device is unable to access any such information, then at reference numeral 212, a determination is made as to whether the wireless device is able to directly receive the distributed radio signal. For example, the wireless device may include an FM transceiver to allow access to radio stations. If it is determined that the device is radio enabled, then at reference numeral 214 a bookmark is generated at least using data associated with the received radio signal. For example, the bookmark may include information such as: the radio frequency to which the device is tuned, location identifying information, a timestamp, a user inputted content item tag, at least a portion of metadata received with a content item, etc. By contrast, if at reference numeral 212 it is determined the device is not radio enabled, then at reference numeral 216, a bookmark may be generated using a pseudo-radio application, or the like, to facilitate identification of the requested content item. In one aspect, the pseudo-radio application may obtain the frequency from which the requested content item was distributed. For example, the user may input the frequency into the pseudo-radio application. Further, additional device operation identifying information may be obtained to generate the bookmark, such as: an audio clip capture of a content item, a WCD location identifier, a timestamp, a user inputted content item tag.

At reference numeral 218, the generated bookmark may be transmitted to a service provider to facilitate obtaining the requested content item. In one aspect, the transmission may be processed over a network using a protocol such as: CDMA, WCDMA, TDMA, TD-SCDMA, UMTS, IP, etc. In one aspect, the request may be transmitted to a service provider different from the service provider that distributed the requested content item. In another aspect, the request may be transmitted to the same service provider that distributed the requested content item.

Figure 3A:
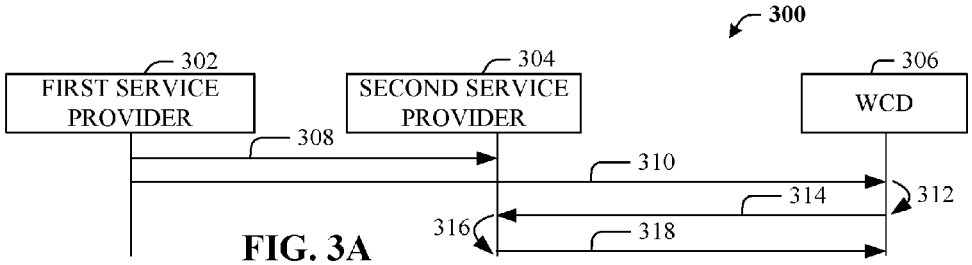
FIG. 3A illustrates a message sequence chart of operation of an aspect depicted in FIG. 1.
Figure 3B:
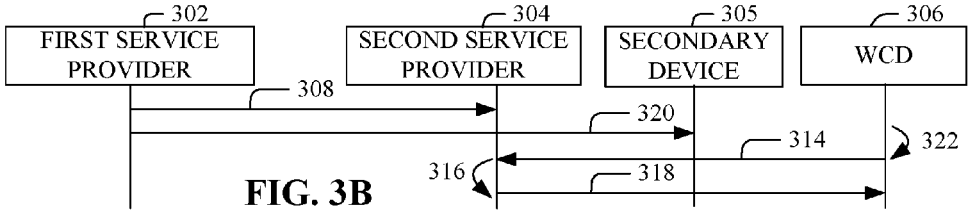
FIG. 3B illustrates a message sequence chart of operation of an aspect depicted in FIG. 1.
Figure 3C:
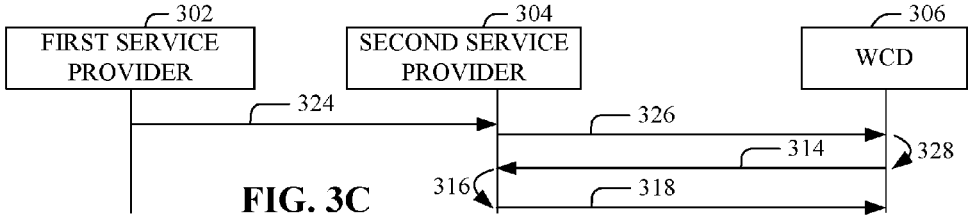
FIG. 3C illustrates a message sequence chart of operation of an aspect depicted in FIG. 1.
Figure 3D:
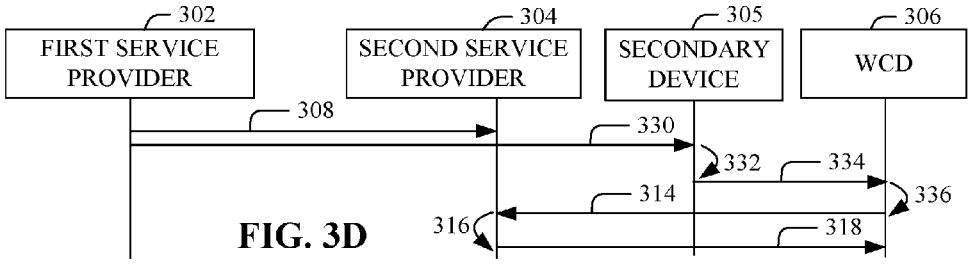
FIG. 3D illustrates a message sequence chart of operation of an aspect depicted in FIG. 1.

With reference to FIGS. 3A, 3B, 3C, 3D and 3E, operation of the subject matter depicted in FIG. 1 in the form of a message sequence diagram is illustrated. Specifically, with reference to FIG. 3A, a message sequence diagram for acquiring a content item distributed by a first service provider with no additional contextual information is illustrated. With reference to FIG. 3B, a message sequence diagram for acquiring a content item distributed by a first service provider with no additional contextual information to a device which is not enabled to directly receive the distributed content item is illustrated. With reference to FIG. 3C, a message sequence diagram for acquiring a content item distributed by a first service provider through a second service provider is illustrated. With reference to FIG. 3D, a message sequence diagram for acquiring a content item distributed by a first service provider to a device which is not enabled to directly receive the distributed content item through use of a secondary intermediary device is illustrated.

Generally, a content distribution system 300 may include first service provider 302, a second service provider 304 and a wireless communications device (WCD) 306. In one aspect, the first and second service providers may be operated as a single service provider. In another aspect, the first service provider and second service provider may be separately operated and/or controlled. With respect to FIGS. 3A-3D, sequence steps which are similar between depicted aspects are numbered accordingly and any description accompanying the first reference to the sequence step number may be similar to subsequent usage. As such, description is provided for only the first usage of a sequence step.

Returning to FIG. 3A, at sequence step 308, first service provider 302, may synchronize content information, such as content distribution schedules with second service provider 304. In one aspect, such synchronization may occur in real time, periodically, or upon request. For example, first service provider 304 may provider a content distribution schedule for twenty four (24) hours worth of content to second service provider 304 at a predefined time each day. At sequence step 310, first service provider 302 distributes content. In the depicted aspect, the content is received by WCD 306. In one aspect, first service provider may broadcast, multicast, or unicast content using a format such as: a frequency modulation (FM) format, an amplitude modulation (AM) format, a satellite radio format, an internet protocol (IP) format, etc.

At sequence step 312, a selection is made on WCD 306 to request to obtain the content item distributed by first service provider 302. Further, such a selection includes generating a bookmark which may include sufficient information to identify the distributed content item. In one aspect, such device identifying information may include: an audio clip capture of a content item, a WCD location identifier, a timestamp, a user inputted content item tag, at least a portion of metadata received with a content item, radio data system (RDS) information for a content item, information obtained from a content guide for a content item, etc.

At sequence step 314, the request including the generated bookmark is transmitted to second service provider 304. In one aspect, WCD 303 may transmit using a protocol such as: CDMA, WCDMA, TDMA, TD-SCDMA, UMTS, IP, etc. At sequence step 316, second service provider 304 processes the request including the accompanying bookmark from WCD 306 along with synchronize content information received from first service provider 304 to identify and obtain the requested content item. In one aspect, the content item may be obtained in a format such as: a .wav file format, an .aac file format, a .qcp file format, a MP3 file format, etc. In one aspect, if second service provider 304 is unable to locate the requested content item, possible alternative content item selections may be obtained. In such an aspect, content from a similar a genre, an artist name, or an album name, etc. may be presented to the user as possible alternatives. At sequence step 318, the obtained content item is transmitted to WCD 306. In one aspect, the obtained content item may be stored on WCD 306 for subsequent access. As such, WCD 306 is able to obtain a content item from second service provider 304 which was distributed by first service provider 302 through information associated with WCD 306. By way of example and not limitation, a user may listen to a song on FM radio associated with a mobile device 306. If the user selects to obtain the song, the user can download the music file (e.g. an MP3 file) of the same song by having the mobile device 306 send information such as the FM frequency number and timestamp to a Content Server (e.g. second service provider 304). The Content Server may use information obtainable for the selected song on the particular FM radio station based on a program schedule. As such, upon receiving the request from the mobile device 306, the Content Server may fetch the song name from the program schedule, search for the song name in a Content Database, fetch the music file (e.g. an MP3 file), and send the fetched file to the mobile device 306.

Turning to FIG. 3B, as described above, at sequence step 308, first service provider 302, may synchronize content information, such as content distribution schedules with second service provider 304. At sequence step 320, first service provider 302 distributes content. In the depicted aspect, the content is received by secondary device 305. In one aspect, secondary device 305 may include a radio player, such as a car stereo, that is accessible to a user. At sequence step 322, upon hearing a content item distributed by first service provider 302 and accessed by secondary device 305, a user may make a selection on WCD 306 to obtain the distributed content item. In one aspect, WCD 306 may include a pseudo-radio application, or the like, which allows a user to select to obtain a content item which is distributed by first service provider. In such an aspect, the pseudo-radio application may generate a bookmark which includes information from the user and/or WCD 306 to sufficiently identify the requested content item. Thereafter, WCD 306 may request the content item from second service provider 304, and sequence steps 314, 316 and 318 may be performed as described above. By way of example and not limitation, a user may listen to a song, although the user isn't necessarily listening to the song through a mobile device. In such an instance, even when a user is listening to a secondary device, such as an FM radio on the car stereo etc., the user can still user can download the music file (e.g. an MP3 file) for the music track of the same song by having a mobile application send content identifying information, such as FM frequency number and timestamp to a Content Server (e.g. second service provider 304). The Content Server may use information obtainable for the selected song on the particular FM radio station based on a program schedule. As such, upon receiving the request from the mobile device 306, the Content Server may fetch the song name from the program schedule, search for the song name in a Content Database, fetch the music file (e.g. an MP3 file), and send the fetched file to the mobile device 306.

Turning now to FIG. 3C, at sequence step 324, at least a content distribution schedule, such as a content guide, is provided from first service provider 302 to second service provider 304. In one aspect, the content distribution schedule describes content distributed by first service provider 302 via a radio transmission. Further, in the depicted aspect, communication to second service provider 304 may include content provided by first service provider 302 for distribution from second service provider 304 via an IP format, such as with a streaming radio signal. At sequence step 326, second service provider 304 distributes content. In one aspect, the signal includes contextual information identifying the content being distributed. For example, a streaming radio signal may include FM RDS data, metadata, etc. identifying the distributed content item. At sequence step 328, a user may make a selection on WCD 306 to obtain the distributed content item. In one aspect, WCD 306 may generate a bookmark to identify the requested content item. For example, WCD 306 may use contextual information accompanying the distributed content item to identify the content item. In one aspect, additional user and/or WCD 306 information may be added to the bookmark to further identify the requested content item, the user, and/or the device. Thereafter, WCD 306 may request the content item from second service provider 304, and sequence steps 314, 316 and 318 may be performed as described above. By way of example and not limitation, a user may access a program guide on the mobile device which was downloaded over the air (OTA). The user may schedule an automatic recording, downloading, reminder, etc. of a particular program, event etc. through accessing the program guide. As such, the mobile device may perform one or more selected tasks, such as: download previously distributed programs; purchase content such as songs from a Content Server Content Database and/or Operator Catalogue, download podcasts audio files, video files, photos etc., get a reminder on the handset when a particular program is scheduled, etc.

Turning now to FIG. 3D, as described above, at sequence step 308, first service provider 302, may synchronize content information, such as content distribution schedules with second service provider 304. At sequence step 330, first service provider 302 distributes content. In the depicted aspect, the content may be transmitted with accompanying contextual information, such as FM RDS data, may be received by secondary device 305. In one aspect, secondary device 305 may include a personal navigation device (PND), etc. that is accessible to a user. Further, in the depicted example, secondary device 305 may be enabled to receive contextual information that may accompany the distribution of content from first service provider 302. For example, a PND may be FM RDS enabled and may receive FM RDS data accompanying the transmission of a song from a radio station. As such, even if WCD is not FM RDS enabled, a user may be able to obtain the FM RDS data that is received by an accompanying secondary device, such as a PND. At sequence step 332, a user may request to obtain the distributed content item. In the depicted aspect, the request may be made to secondary device 305. Additionally or in the alternative, a selection may be made to WCD 306 which may be communicated to secondary device 305 for further processing. Furthermore, secondary device 305 may identify the requested content item through contextual information accompanying the distributed content item to identify the content item. Further, additional user and/or secondary device 305 information may be obtained to the bookmark to further identify the requested content item, the user, and/or the secondary device. At sequence step 334, the user selection may be transmitted to WCD 306. In one aspect, such a transmission may be performed either through a wired or wireless connection. For example, secondary device 305 may communicate with WCD 306 over the air using an applicable transmission protocol such as but not limited to, WiFi, Bluetooth, etc. Further, the contextual information provided to the WCD may include a timestamp, FM station number, etc. At sequence step 336, WCD may generate a bookmark to identify the requested content item. In another aspect, said bookmark may be generated by and transmitted from secondary device 305. In one aspect, additional user and/or WCD 306 information may be added to the bookmark to further identify the requested content item, the user, and/or the device. Thereafter, WCD 306 may request the content item from second service provider 304, and sequence steps 314, 316 and 318 may be performed as described above.

Figure 3E:
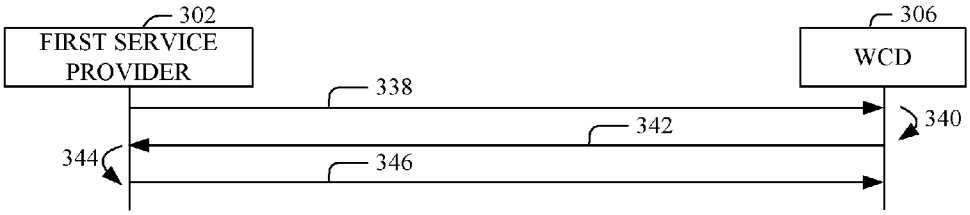
FIG. 3E illustrates a message sequence chart of operation of an aspect depicted in FIG. 1.

Turning now to FIG. 3E, at sequence step 338, first service provider 302 distributes content to WCD 306. At sequence step 340, an application on WCD 306 may be launched and to receive distributed content. For example, when the distributed content is a FM broadcast with audio only, an application may launch on WCD 306 and tune to the FM broadcast. At sequence step 342, based at least on information processed from the received signal, WCD 306 transmits a request for additional data associated with the received content item, the first service provider, etc. Continuing the above example, the additional data may include possible content items available for download, storage, playing, etc., displays associated with the distributed content, the first service provider, additional content, etc.

At sequence step 344, a server, etc., associated with at least the first service provider may fetch the requested additional content items. For example, a server associated with at least first service provider 302 may fetch program schedule data for various FM broadcast stations. In one aspect, the server may be associated with only the first service provider 302. In another aspect, the server may be shared and/or may communicate with multiple service providers. For example, an FM station may offer access to content via one or more servers (e.g. a web servers) hosted by the FM station and/or the one or more servers may be hosted by another station, a third party, etc., that may aggregate such content from various FM stations and offer such aggregated content to a WCD. Further, the fetched data may be parsed and/or searched for corresponding music, pictures, talk shows, blogs, contests, interactive voice response (IVR) calls, news articles, videos, wallpaper, etc. in a database.

Still further, at least a portion of such fetched content may be stored and made available to WCD 306 as requested at sequence step 342. In one aspect, the request may provide appropriate request/response contents for content, such as HTTP request/response commands. In one aspect, at sequence step 344, fetched content may be further processed to format the content appropriately for WCD 306. At sequence step 346, requested additional content may be transmitted to WCD 306. In one aspect, the request and/or transmission may be made using formats such as, but not limited to, XML, JSON or other similar data exchange languages. As such, for example, if a new FM station is established at a future date, such a station may provide content to a WCD using one of the predefined described formats without any need to update and/or upgrade the WCD. In another aspect, any request and/or transmission between first service provider 302, WCD 306 and/or any associated server may use an SMS, MMS, EMS, etc. format. As such, for example, while listening to a particular FM station on a WCD, a user may receive content offered by that particular FM station which may or may not be related to the content to which a user is currently listening.

In one aspect, WCD 306 may additionally receive distributed content from another service provider, such as one or more additional radio stations and/or one or more servers. In such an aspect, sequence steps 338 through 346 may be performed with respect to the each of the one or more radio stations to which WCD 306 may be tuned.

Figure 4:
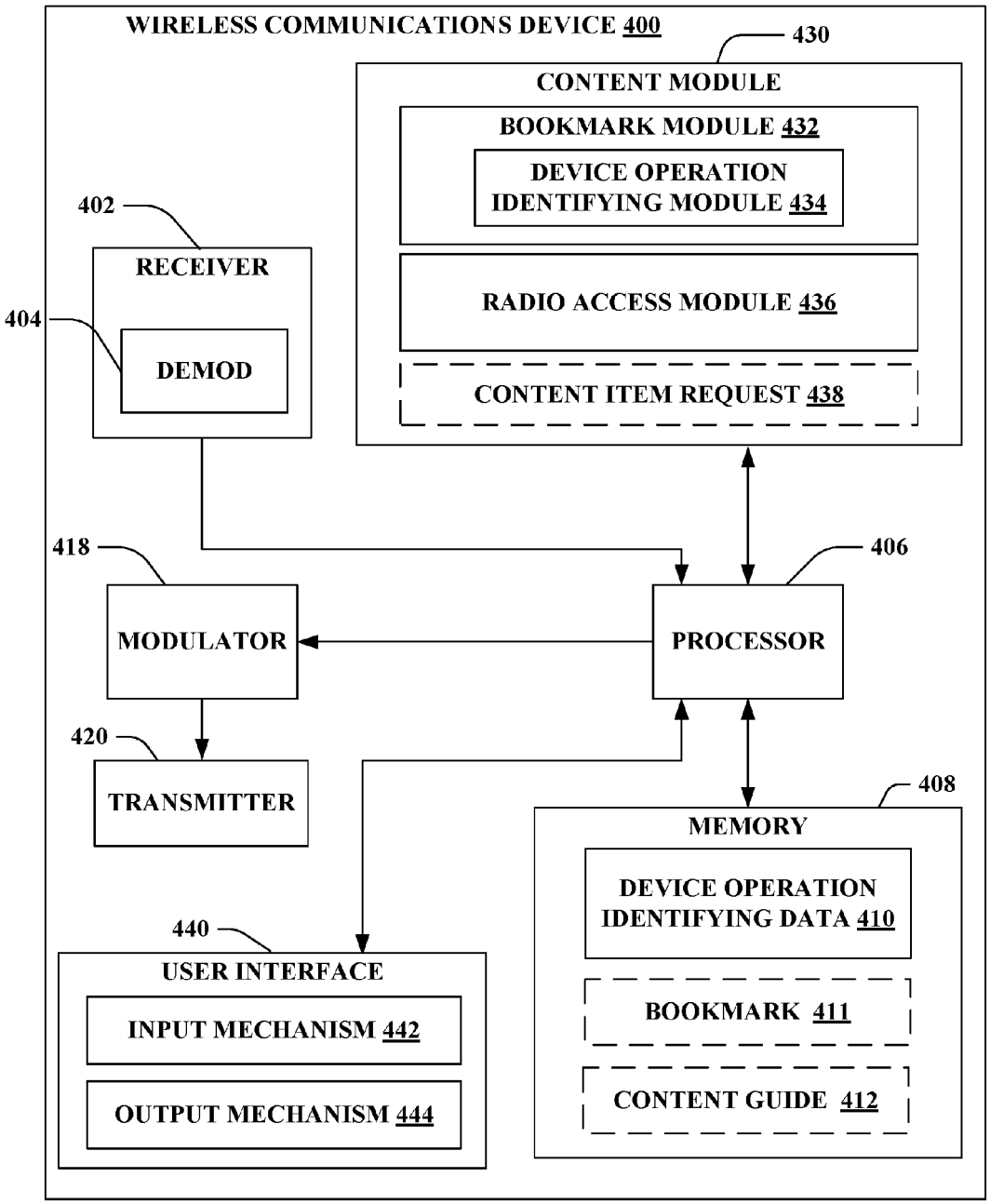
FIG. 4 illustrates a block diagram example architecture of a wireless communications device.

While still referencing FIG. 1, but turning also now to FIG. 4, an example architecture of wireless communications device 110 is illustrated. As depicted in FIG. 4, wireless communications device 400 comprises receiver 402 that receives a signal from, for instance, a receive antenna (not shown), performs typical actions on (e.g., filters, amplifies, downconverts, etc.) the received signal, and digitizes the conditioned signal to obtain samples. Receiver 402 can comprise a demodulator 404 that can demodulate received symbols and provide them to processor 406 for channel estimation. Processor 406 can be a processor dedicated to analyzing information received by receiver 402 and/or generating information for transmission by transmitter 420, a processor that controls one or more components of wireless communications device 400, and/or a processor that both analyzes information received by receiver 402, generates information for transmission by transmitter 420, and controls one or more components of wireless communications device 400.

Wireless communications device 400 can additionally comprise memory 408 that is operatively coupled to processor 406 and that can store data to be transmitted, received data, information related to available channels, data associated with analyzed signal and/or interference strength, information related to an assigned channel, power, rate, or the like, and any other suitable information for estimating a channel and communicating via the channel. Memory 408 can additionally store protocols and/or algorithms associated with estimating and/or utilizing a channel (e.g., performance based, capacity based, etc.). In one aspect, memory 408 can include device operation identifying data 410, such as but not limited to: an audio clip capture of a content item, a WCD location identifier, a timestamp, a user inputted content item tag, at least a portion of metadata received with a content item, radio data system (RDS) information for a content item, information obtained from a content guide for a content item, etc. In one aspect, memory 408 can include bookmark 411, which may include device operation identifying data 410 coupled to a content item. In such an aspect, a bookmark may include at least one of: data linked to the first content item, data defining the first content item, or a link to the first content item. Further, in such an aspect, the link to the first content item may further include an active link to the first content item to allow the bookmark to be updated at a predetermined interval of time, such as periodically, upon a user selection, etc. Still further, bookmarks 411 may be tagged with searchable keywords and stored accordingly. In one aspect, memory 408 can include content guide 412, which may be obtained from a service provider, such as first service provider 130, and may provide information associated with content items distributed by the service provider, such as first service provider 130. In one aspect, content guide 412 may be obtained from any of: a second computing device coupled to WCD 400, a first service provider, a second service provider, etc. In one aspect, content guide 412 may be bookmarked by bookmark module 432.

It will be appreciated that data store (e.g., memory 408) described herein can be either volatile memory or nonvolatile memory, or can include both volatile and nonvolatile memory. By way of illustration, and not limitation, nonvolatile memory can include read only memory (ROM), programmable ROM (PROM), electrically programmable ROM (EPROM), electrically erasable PROM (EEPROM), or flash memory. Volatile memory can include random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM). Memory 408 of the subject systems and methods may comprise, without being limited to, these and any other suitable types of memory.

Wireless communications device 400 can further include content module 430 to facilitate obtaining and/or identifying a content item distributed by a service provider, such as first service provider 130. Content module 430 may further comprise bookmark module 432 to assist content module 430 in coupling WCD 400 related attributes to any content items received from a first service provider. In one aspect, bookmark module may further include device operation identifying module 434 to obtain device identifying characteristics, such as but not limited to: an audio clip capture of a content item, a WCD location identifier, a timestamp, a user inputted content item tag, at least a portion of metadata received with a content item, radio data system (RDS) information for a content item, or information obtained from a content guide for a content item, etc. Content module 430 may further comprise radio access module 432 to facilitating accessing a signal from a first service provider, such as an FM station, AM station, satellite radio station, etc.

In one aspect, content module 430 may further comprise content item request 434 to identify a selection by a user or the like to obtain a content item, such as a song played over the radio. In one aspect, content item request 434 may be coupled to device operation identifying data 410 through device operation identifying module 4343 to aid WCD 400 in determining the requested content item. Additionally, content module 430 may further facilitate transmitting content item request 438 to a second service provider, such as a cellular network service provider, an internet service provider, etc. to identify and locate the requested content item. For example, WCD 400 may transmit content item request 438 to an internet based service provider (second service provider) that has access to a radio stations (first service provider) playlist. In such an exemplary aspect, accompanying device operation identifying data may allow the internet based service provider to identify the song that was played by the radio station and requested by WCD 400.

Additionally, wireless communications device 400 may include user interface 440. User interface 440 may include input mechanisms 442 for generating inputs into communications device 400, and output mechanism 442 for generating information for consumption by the user of the communications device 400. For example, input mechanism 442 may include a mechanism such as a key or keyboard, a mouse, a touch-screen display, a microphone, etc. Further, for example, output mechanism 444 may include a display, an audio speaker, a haptic feedback mechanism, a Personal Area Network (PAN) transceiver etc. In the illustrated aspects, the output mechanism 444 may include a display operable to present media content that is in image or video format or an audio speaker to present media content that is in an audio format.

In operation, wireless communication device 400 may receive a content item signal distributed by first service provider through receiver 402. Further, in such an aspect, receiver 402 may be receiving using a format such as but not limited to: a frequency modulation (FM) format, or an amplitude modulation (AM) format, or a satellite radio format, or an internet protocol (IP) format. Further, in such an aspect, radio access module 536 may process the received signal. Further, in operation, content module 430 may generate a content item request 438 to obtain access to a content item, or a version thereof, recovered by receiver 402. Further, in one aspect, to assist in identifying and obtaining the request content item 438, bookmark module 432 may link at least one device operation identifying data item 410 to the content item request 438. In one aspect, upon generating content item request 438, wireless communications device 400 may transmit the content item request 420 via transmitter 420 to a second service provider server. In one aspect, For example, transmitter 420 may transmit using a protocol such as: CDMA, WCDMA, TDMA, TD-SCDMA, UMTS, IP, etc. Thereafter, the obtained content item may be transmitted to wireless communications device 400 for storage in memory 408, access, etc.

Accordingly, wireless communications device 400 may obtain the requested content item 438 that was distributed by a first service provider, such as a radio station, by providing data identifying the wireless communications device 400 sufficiently to allow a second service provider 140, such as an internet based service provider to identify the requested content item 438.

Figure 5:
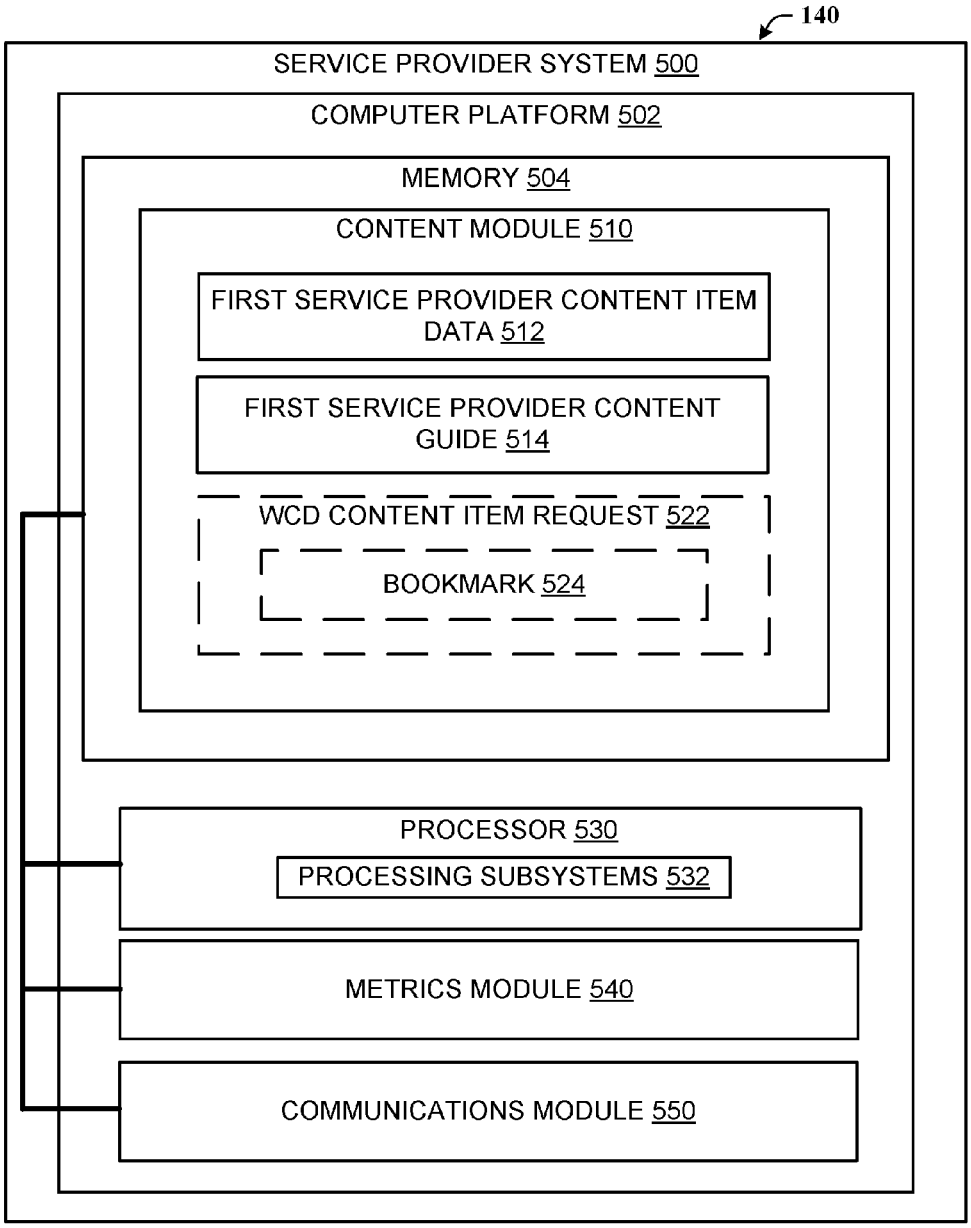
FIG. 5 illustrates exemplary block diagram of an service provider system according to an aspect.

With reference to FIG. 5, illustrated is a detailed block diagram of service provider system 500, such as first and/or second service provider servers 130, 140 depicted in FIG. 1. Service provider system 500 may comprise at least one of any type of hardware, server, personal computer, mini computer, mainframe computer, or any computing device either special purpose or general computing device. Further, the modules and applications described herein as being operated on or executed by service provider system 500 may be executed entirely on a single network device, as shown in FIG. 5, or alternatively, in other aspects, separate servers, databases or computer devices may work in concert to provide data in usable formats to parties, and/or to provide a separate layer of control in the data flow between communications devices 110 and the modules and applications executed by service provider system 500.

Service provider system 500 includes computer platform 502 that can transmit and receive data across wired and wireless networks, and that can execute routines and applications. Computer platform 502 includes memory 504, which may comprise volatile and nonvolatile memory such as read-only and/or random-access memory (ROM and RAM), EPROM, EEPROM, flash cards, or any memory common to computer platforms. Further, memory 504 may include one or more flash memory cells, or may be any secondary or tertiary storage device, such as magnetic media, optical media, tape, or soft or hard disk. Further, computer platform 502 also includes processor 530, which may be an application-specific integrated circuit ("ASIC"), or other chipset, logic circuit, or other data processing device. Processor 530 may include various processing subsystems 532 embodied in hardware, firmware, software, and combinations thereof, that enable the functionality of media content distribution system 14 and the operability of the network device on a wired or wireless network.

Computer platform 502 further includes communications module 550 embodied in hardware, firmware, software, and combinations thereof, that enables communications among the various components of service provider system 500, as well as between service provider system 500, devices 110, and service provider servers 130, 140. Communication module 550 may include the requisite hardware, firmware, software and/or combinations thereof for establishing a wireless communication connection. According to described aspects, communication module 550 may include the necessary hardware, firmware and/or software to facilitate wireless broadcast, multicast and/or unicast communication of requested content items, content guides, etc.

Computer platform 502 further includes metrics module 540 embodied in hardware, firmware, software, and combinations thereof, that enables metrics received from device 110 corresponding to, among other things, data communicated from device 110 and/or data identifying device 110. In one aspect, service provider system 500 may analyze data received through metrics module 540 to modify possible content available for future distribution to device 110. For example, if the metrics module returns data indicating the user is actively seeking audio files of a specific genre of music, then the service provider system 500 may suggest content similar to sought after genre 512. In another aspect, assuming the requested content item is unavailable, metrics module 540 may assist in providing suggested related content items.

Memory 504 of service provider system 500 includes content module 510 operable to process a WCD content item request 522 coupled to a bookmark 524. In one aspect, a bookmark 524 may include at least one of: data linked to the first content item, data defining the first content item, or a link to the first content item. Further, in such an aspect, the link to the first content item may further include an active link to the first content item to allow the bookmark to be updated at a predetermined interval of time, such as periodically, upon a user selection, etc. Still further, bookmarks 524 may be tagged with searchable keywords and stored accordingly. In one aspect, content module 510 may include first service provider content item data 512 and first service provider content guide 514. In one aspect, content guide 514 may be bookmarked. First service provider content item data 512 may include information, such as FM RDS data, that allows content module 510 to match WCD content item request 522 to the requested content item. In one aspect, First service provider content item data 512 may be coupled to and/or organized by first service provider content guide 514. In such an aspect, WCD content item request 522 may include reference to an entry in first service provider content guide 514 thereby coupling the content item requested by a WCD with a content item associated with the first service provider. Content module 510 may provide for unicast delivery, broadcast delivery, multicast delivery or any other known or future known wireless delivery mechanism capable of delivering the requested content item to the WCD across a network 120. Each WCD content item request 522 coupled to a bookmark 524 may include information useful in assisting metrics module 540 in analyzing application related data.

In operation, for example, device 110 may request a content item (e.g. an audio file) through a content module on device 110. Such a request may be accompanied by at least one WCD operation identifying item coupling the request to information received from another service provider (e.g. RDS data from a radio station). This request may be processed by service provider system 500. Upon obtaining of the content item (e.g. audio file), service provider system 500 may transmit the content item to the requesting device. During processing of such a request, service provider server may store information related to device 110, the requested content item (e.g. audio file), etc. Such information, along with information obtained from other devices, may be analyzed by metrics module 540 and results such as, song popularity, number of times a song has been played, etc., may be derived.

Figure 6:
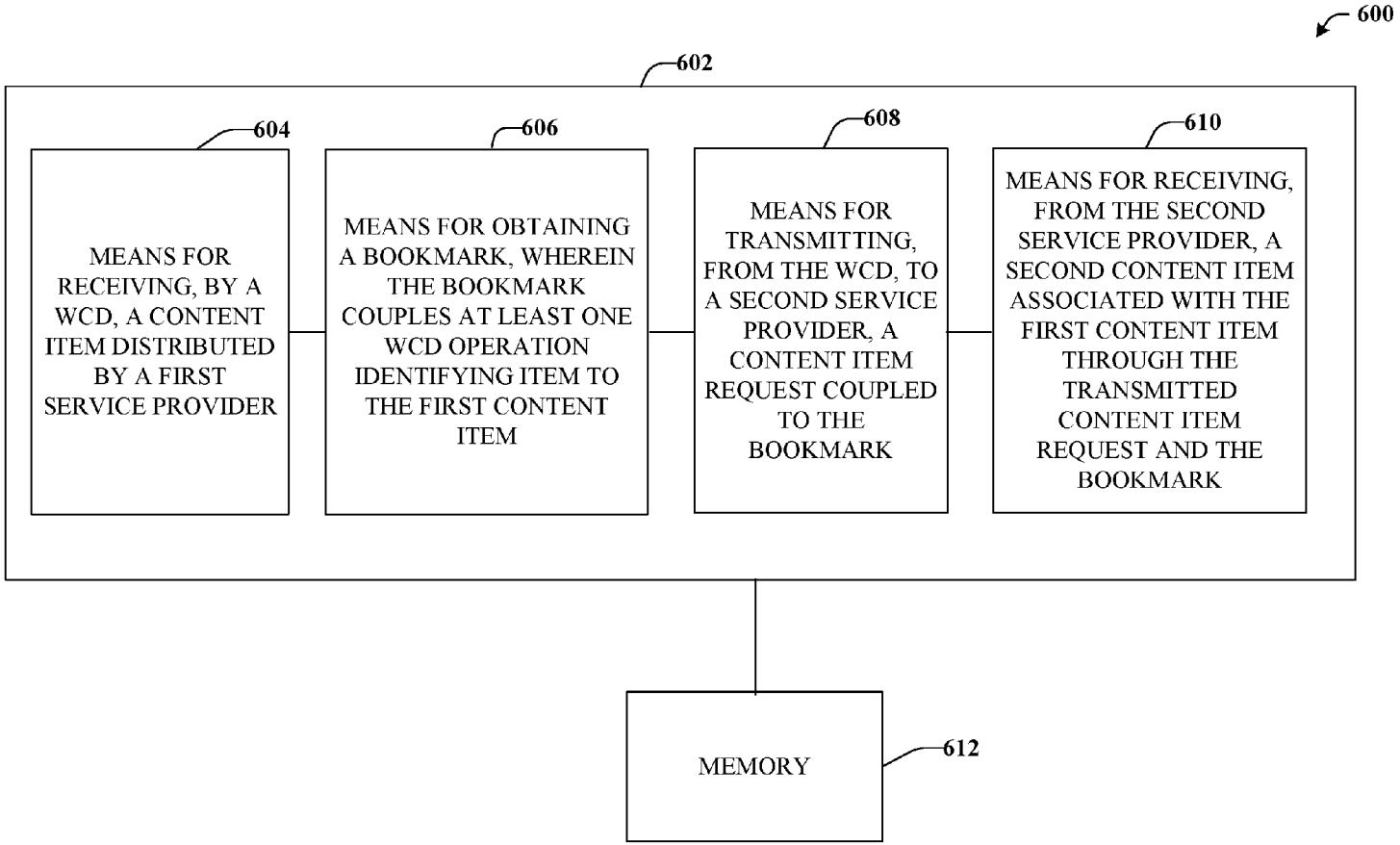
FIG. 6 illustrates a block diagram of an exemplary communications device that can obtain content distributed to a wireless communications device.

With reference to FIG. 6, a block diagram of an exemplary system 600 that can obtain content distributed to a wireless communications device is illustrated. For example, system 600 can reside at least partially within a wireless device. According to another example aspect, system 600 can reside at least partially within an access terminal. It is to be appreciated that system 600 is represented as including functional blocks, which can be functional blocks that represent functions implemented by a processor, software, or combination thereof (e.g., firmware). System 600 includes a logical grouping 602 of means that can act in conjunction. For instance, logical grouping 602 can include means for receiving, by a wireless communications device (WCD), a content item distributed by a first service provider 604. In one aspect, a content reception application may be initiated either by a user selection, or automatically in response to receiving the content item. In another aspect, the content item is distributed by at least one of: broadcasting, or multicasting or unicasting the content item. In still another aspect, the first content item may be received using a format including at least one of: a frequency modulation (FM) format, an amplitude modulation (AM) format, a satellite radio format, or an internet protocol (IP) format.

Further, logical grouping 602 can comprise means for obtaining a bookmark, wherein the bookmark couples at least one WCD operation identifying item to the first content item 606. For example, the device operation identifying item may include at least one of: an audio clip capture of the first content item, a WCD location identifier, a timestamp, a user inputted first content item tag, at least a portion of metadata received with the first content item, radio data system (RDS) information for the content item, or information obtained from a content guide for the first content item. In one aspect, the bookmark may be generated by the WCD. In another aspect, the bookmark may be received from another computing device and/or a server. Further, logical grouping 602 can comprise means for transmitting, from the WCD, to a second service provider, a content item request coupled to the bookmark 608. For example, the request may be transmitted over a network using a protocol such as: CDMA, WCDMA, TDMA, TD-SCDMA, UMTS, IP, etc. Further, logical grouping 602 can comprise means for receiving, from the second service provider, a second content item associated with the first content item through the transmitted content item request and the bookmark 610. As such, a wireless communications device may obtain a content item via a second service provider through context information associated with the content item distributed by a first service provider, where the wireless communications device may not directly process the context information. Additionally, system 600 can include a memory 612 that retains instructions for executing functions associated with the means 604, 606, 608 and 610. While shown as being external to memory 612, it is to be understood that one or more of the means 604, 606, 608 and 610 can exist within memory 612.

Figure 7:
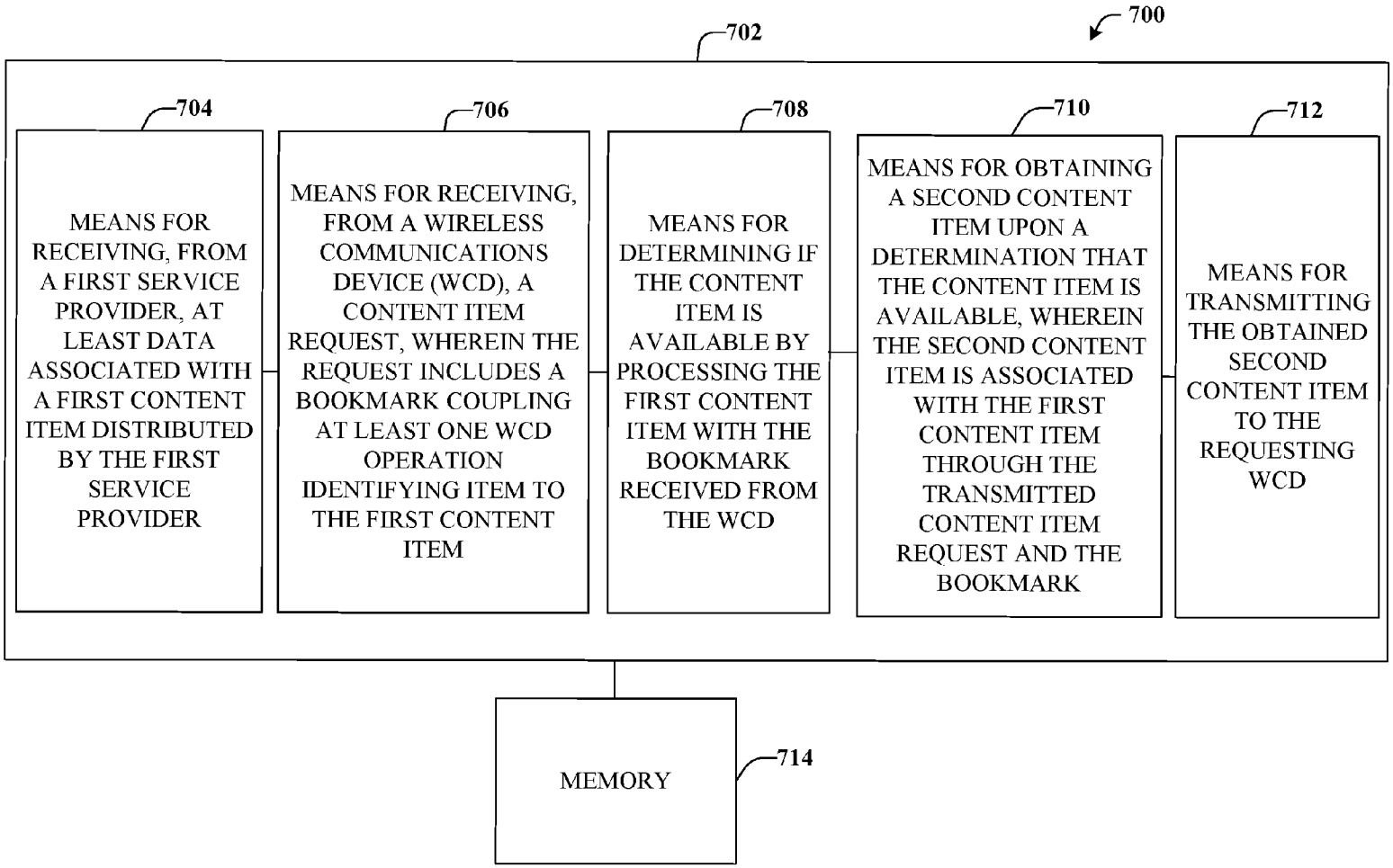
FIG. 7 illustrates a block diagram of an exemplary network device that can facilitate distribution of content to a wireless communications device.

With reference to FIG. 7, a block diagram of an exemplary system 700 that can facilitate distribution of content to a wireless communications device is illustrated. For example, system 700 can reside at least partially within a wireless device. According to another example aspect, system 700 can reside at least partially within an access terminal. It is to be appreciated that system 700 is represented as including functional blocks, which can be functional blocks that represent functions implemented by a processor, software, or combination thereof (e.g., firmware). System 700 includes a logical grouping 702 of means that can act in conjunction. For instance, logical grouping 702 can include means for receiving, from a first service provider, a first content item distributed by the first service provider 704. In one aspect, the first format may include at least one of: a frequency modulation (FM) format, an amplitude modulation (AM) format, a satellite radio format, or an internet protocol (IP) format. In another aspect, the first service provider may additionally, or in the alternative, provide a content guide, wherein the content guide includes information coupled to the content item. Further, logical grouping 702 can comprise means for receiving, from a wireless communications device (WCD), a content item request, wherein the request includes a bookmark coupling at least one WCD operation identifying item to the first content item 706. In one aspect, the at least one WCD operation identifying item may include: an audio clip capture of the content item, a WCD location identifier, a timestamp, a user inputted content item tag, at least a portion of metadata received with the content item, radio data system (RDS) information for the content item, information obtained from a content guide for the content item, etc. In another aspect, continuing the above example, a request may be received as a selection of a content item through a selection from the content guide. Further, logical grouping 702 can comprise means for determining if the content item is available by processing the first content item with the bookmark received from the WCD 708. In one aspect, upon a determination that the content item is unavailable, an option for at least one related content item may be obtained. In such an aspect, the at least one related content item may be determined by selecting one or more content items with at least one of: a genre, an artist name, or an album name in common with the requested content item. Further, logical grouping 702 can comprise means for obtaining a second content item upon a determination that the content item is available, wherein the second content item is associated with the first content item through the transmitted content item request and the bookmark 710. For example, the second format may include at least one of: a .wav file format, an .aac file format, a .qcp file format, or a MP3 file format. Further, logical grouping 702 can comprise means for transmitting the obtained second content item to the requesting WCD 712. In one aspect, the content item may be transmitted over a network using a protocol selected from the group of protocols comprising: CDMA, WCDMA, TDMA, TD-SCDMA, UMTS, IP, GSM, LTE, WiMax, WiFi, UMB, etc. As such, a second service provider server may process requests for content items from information associated with content distributed to a wireless device from a first service provider. Additionally, system 700 can include a memory 714 that retains instructions for executing functions associated with the means 704, 706, 708, 710 and 712. While shown as being external to memory 714, it is to be understood that one or more of the means 704, 706, 708, 710 and 712 can exist within memory 714.

Figure 8:
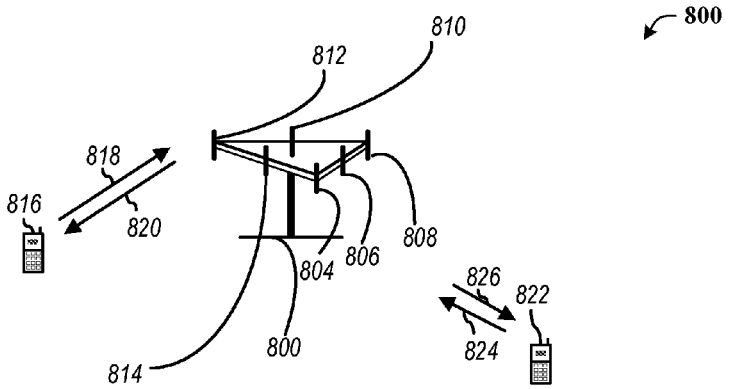
FIG. 8 illustrates an exemplary multiple access wireless communication system according to an aspect.

Referring to FIG. 8, a multiple access wireless communication system according to one aspect is illustrated. An access point 800 (AP) includes multiple antenna groups, one including 804 and 806, another including 808 and 810, and an additional including 812 and 814. In FIG. 8, only two antennas are shown for each antenna group, however, more or fewer antennas may be utilized for each antenna group. Access terminal 816 (AT) is in communication with antennas 812 and 814, where antennas 812 and 814 transmit information to access terminal 816 over forward link 820 and receive information from access terminal 816 over reverse link 818. Access terminal 822 is in communication with antennas 806 and 808, where antennas 806 and 808 transmit information to access terminal 822 over forward link 826 and receive information from access terminal 822 over reverse link 824. In a FDD system, communication links 818, 820, 824 and 826 may use different frequency for communication. For example, forward link 820 may use a different frequency then that used by reverse link 818.

Each group of antennas and/or the area in which they are designed to communicate is often referred to as a sector of the access point. In the aspect, antenna groups each are designed to communicate to access terminals in a sector, of the areas covered by access point 800.

In communication over forward links 820 and 826, the transmitting antennas of access point 800 utilize beamforming in order to improve the signal-to-noise ratio of forward links for the different access terminals 816 and 824. Also, an access point using beamforming to transmit to access terminals scattered randomly through its coverage causes less interference to access terminals in neighboring cells than an access point transmitting through a single antenna to all its access terminals.

An access point may be a fixed station used for communicating with the terminals and may also be referred to as a Node B or some other terminology. An access terminal may also be called user equipment (UE), a wireless communication device, terminal, or some other terminology.

Figure 9:
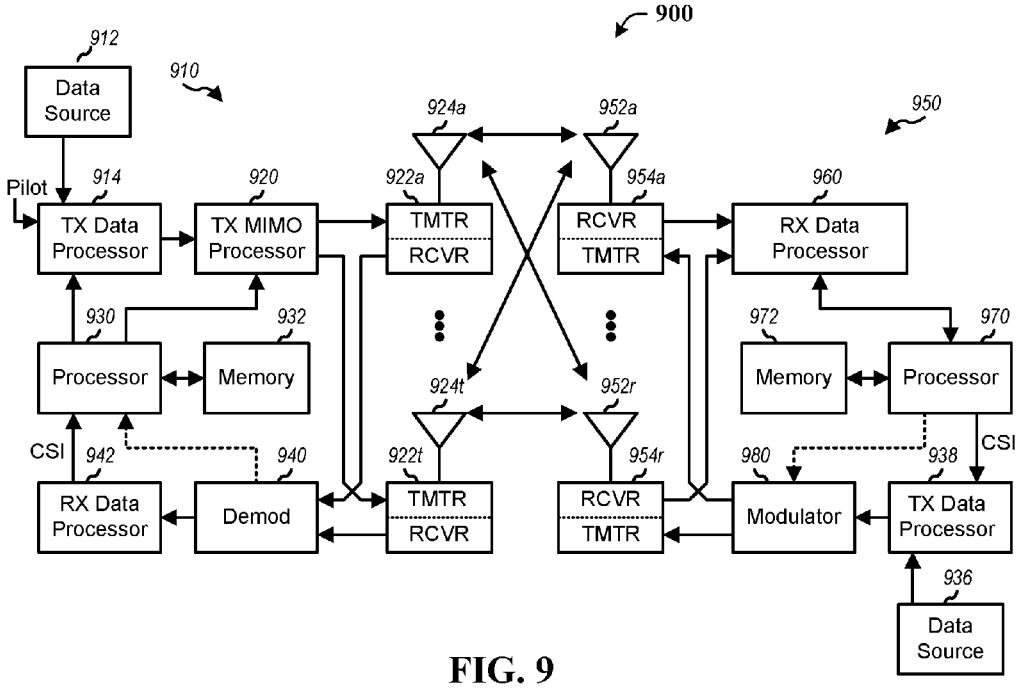
FIG. 9 depicts a block diagram of an exemplary communication system.

Referring to FIG. 9, a block diagram of an aspect of a transmitter system 910 (also known as the access point) and a receiver system 950 (also known as access terminal) in a MIMO system 900 is illustrated. At the transmitter system 910, traffic data for a number of data streams is provided from a data source 912 to a transmit (TX) data processor 914.

In an aspect, each data stream is transmitted over a respective transmit antenna. TX data processor 914 formats, codes, and interleaves the traffic data for each data stream based on a particular coding scheme selected for that data stream to provide coded data.

The coded data for each data stream may be multiplexed with pilot data using OFDM techniques. The pilot data is typically a known data pattern that is processed in a known manner and may be used at the receiver system to estimate the channel response. The multiplexed pilot and coded data for each data stream is then modulated (e.g., symbol mapped) based on a particular modulation scheme (e.g., BPSK, QSPK, M-PSK, or M-QAM) selected for that data stream to provide modulation symbols. The data rate, coding, and modulation for each data stream may be determined by instructions performed by processor 930.

The modulation symbols for all data streams are then provided to a TX MIMO processor 920, which may further process the modulation symbols (e.g., for OFDM). TX MIMO processor 920 then provides $N_T$ modulation symbol streams to $N_T$ transmitters (TMTR) 922*a* through 922*t*. In certain aspects, TX MIMO processor 920 applies beamforming weights to the symbols of the data streams and to the antenna from which the symbol is being transmitted.

Each transmitter 922 receives and processes a respective symbol stream to provide one or more analog signals, and further conditions (e.g., amplifies, filters, and upconverts) the analog signals to provide a modulated signal suitable for transmission over the MIMO channel. $N_T$ modulated signals from transmitters 922*a* through 922*t* are then transmitted from $N_T$ antennas 924*a* through 924*t*, respectively.

At receiver system 950, the transmitted modulated signals are received by $N_R$ antennas 952*a* through 952*r* and the received signal from each antenna 952 is provided to a respective receiver (RCVR) 954*a* through 954*r*. Each receiver 954 conditions (e.g., filters, amplifies, and downconverts) a respective received signal, digitizes the conditioned signal to provide samples, and further processes the samples to provide a corresponding "received" symbol stream.

An RX data processor 960 then receives and processes the $N_R$ received symbol streams from $N_R$ receivers 954 based on a particular receiver processing technique to provide $N_T$ "detected" symbol streams. The RX data processor 960 then demodulates, deinterleaves, and decodes each detected symbol stream to recover the traffic data for the data stream. The processing by RX data processor 960 is complementary to that performed by TX MIMO processor 920 and TX data processor 914 at transmitter system 910.

A processor 970 periodically determines which pre-coding matrix to use (discussed below). Processor 970 formulates a reverse link message comprising a matrix index portion and a rank value portion.

The reverse link message may comprise various types of information regarding the communication link and/or the received data stream. The reverse link message is then processed by a TX data processor 938, which also receives traffic data for a number of data streams from a data source 936, modulated by a modulator 980, conditioned by transmitters 954*a* through 954*r*, and transmitted back to transmitter system 910.

At transmitter system 910, the modulated signals from receiver system 950 are received by antennas 924, conditioned by receivers 922, demodulated by a demodulator 940, and processed by a RX data processor 942 to extract the reserve link message transmitted by the receiver system 950. Processor 930 then determines which pre-coding matrix to use for determining the beamforming weights then processes the extracted message.

In an aspect, logical channels are classified into Control Channels and Traffic Channels. Logical Control Channels comprises Broadcast Control Channel (BCCH) which is DL channel for broadcasting system control information. Paging Control Channel (PCCH) which is DL channel that transfers paging information. Multicast Control Channel (MCCH) which is Point-to-multipoint DL channel used for transmitting Multimedia Broadcast and Multicast Service (MBMS) scheduling and control information for one or several MTCHs. Generally, after establishing RRC connection this channel is only used by UEs that receive MBMS (Note: old MCCH+MSCH). Dedicated Control Channel (DCCH) is Point-to-point bi-directional channel that transmits dedicated control information and used by UEs having an RRC connection. In an aspect, Logical Traffic Channels comprises a Dedicated Traffic Channel (DTCH) which is Point-to-point bi-directional channel, dedicated to one UE, for the transfer of user information. Also, a Multicast Traffic Channel (MTCH) for Point-to-multipoint DL channel for transmitting traffic data.

In an aspect, Transport Channels are classified into DL and UL. DL Transport Channels comprises a Broadcast Channel (BCH), Downlink Shared Data Channel (DL-SDCH) and a Paging Channel (PCH), the PCH for support of UE power saving (DRX cycle is indicated by the network to the UE), broadcasted over entire cell and mapped to PHY resources which can be used for other control/traffic channels. The UL Transport Channels comprises a Random Access Channel (RACH), a Request Channel (REQCH), an Uplink Shared Data Channel (UL-SDCH) and plurality of PHY channels.

The PHY channels comprise a set of DL channels and UL channels.

The DL PHY channels may comprise:

- Common Pilot Channel (CPICH)
- Synchronization Channel (SCH)
- Common Control Channel (CCCH)
- Shared DL Control Channel (SDCCH)
- Multicast Control Channel (MCCH)
- Shared UL Assignment Channel (SUACH)
- Acknowledgement Channel (ACKCH)
- DL Physical Shared Data Channel (DL-PSDCH)
- UL Power Control Channel (UPCCH)
- Paging Indicator Channel (PICH)
- Load Indicator Channel (LICH)

The UL PHY Channels may comprise:

- Physical Random Access Channel (PRACH)
- Channel Quality Indicator Channel (CQICH)
- Acknowledgement Channel (ACKCH)
- Antenna Subset Indicator Channel (ASICH)
- Shared Request Channel (SREQCH)
- UL Physical Shared Data Channel (UL-PSDCH)
- Broadband Pilot Channel (BPICH)

In an aspect, a channel structure is provided that preserves low PAR (at any given time, the channel is contiguous or uniformly spaced in frequency) properties of a single carrier waveform.

For the purposes of the present document, the following abbreviations may apply:

AM Acknowledged Mode
AMD Acknowledged Mode Data
ARQ Automatic Repeat Request
BCCH Broadcast Control CHannel
BCH Broadcast CHannel
C- Control-
CCCH Common Control CHannel
CCH Control CHannel
CCTrCH Coded Composite Transport Channel
CP Cyclic Prefix
CRC Cyclic Redundancy Check
CTCH Common Traffic CHannel
DCCH Dedicated Control CHannel
DCH Dedicated CHannel
DL DownLink
DSCH Downlink Shared CHannel
DTCH Dedicated Traffic CHannel
FACH Forward link Access CHannel
FDD Frequency Division Duplex
L1 Layer 1 (physical layer)
L2 Layer 2 (data link layer)
L3 Layer 3 (network layer)
LI Length Indicator
LSB Least Significant Bit
MAC Medium Access Control
MBMS Multimedia Broadcast Multicast Service
MCCH MBMS point-to-multipoint Control CHannel
MRW Move Receiving Window
MSB Most Significant Bit
MSCH MBMS point-to-multipoint Scheduling CHannel
MTCH MBMS point-to-multipoint Traffic CHannel
PCCH Paging Control CHannel
PCH Paging CHannel
PDU Protocol Data Unit
PHY PHYsical layer
PhyCH Physical CHannels
RACH Random Access CHannel
RLC Radio Link Control
RRC Radio Resource Control
SAP Service Access Point
SDU Service Data Unit
SHCCH SHared channel Control CHannel
SN Sequence Number
SUFI SUper FIeld
TCH Traffic CHannel
TDD Time Division Duplex
TFI Transport Format Indicator
TM Transparent Mode
TMD Transparent Mode Data
TTI Transmission Time Interval
U- User-
UE User Equipment
UL UpLink
UM Unacknowledged Mode
UMD Unacknowledged Mode Data
UMTS Universal Mobile Telecommunications System
UTRA UMTS Terrestrial Radio Access
UTRAN UMTS Terrestrial Radio Access Network
MBSFN multicast broadcast single frequency network
MCE MBMS coordinating entity
MCH multicast channel
DL-SCH downlink shared channel
MSCH MBMS control channel
PDCCH physical downlink control channel
PDSCH physical downlink shared channel As used in this application, the terms "component," "module," "system" and the like are intended to include a computer-related entity, such as but not limited to hardware, firmware, a combination of hardware and software, software, or software in execution. For example, a component may be, but is not limited to being, a process running on a processor, a processor, an object, an executable, a thread of execution, a program, and/or a computer. By way of illustration, both an application running on a computing device and the computing device can be a component. One or more components can reside within a process and/or thread of execution and a component may be localized on one computer and/or distributed between two or more computers. In addition, these components can execute from various computer readable media having various data structures stored thereon. The components may communicate by way of local and/or remote processes such as in accordance with a signal having one or more data packets, such as data from one component interacting with another component in a local system, distributed system, and/or across a network such as the Internet with other systems by way of the signal.

Furthermore, various aspects are described herein in connection with a terminal, which can be a wired terminal or a wireless terminal. A terminal can also be called a system, device, subscriber unit, subscriber station, mobile station, mobile, mobile device, remote station, remote terminal, access terminal, user terminal, terminal, communication device, user agent, user device, or user equipment (UE). A wireless terminal may be a cellular telephone, a satellite phone, a cordless telephone, a Session Initiation Protocol (SIP) phone, a wireless local loop (WLL) station, a personal digital assistant (PDA), a handheld device having wireless connection capability, a computing device, or other processing devices connected to a wireless modem. Moreover, various aspects are described herein in connection with a base station. A base station may be utilized for communicating with wireless terminal(s) and may also be referred to as an access point, a Node B, or some other terminology.

Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form.

The techniques described herein may be used for various wireless communication systems such as CDMA, TDMA, FDMA, OFDMA, SC-FDMA and other systems. The terms "system" and "network" are often used interchangeably. A CDMA system may implement a radio technology such as Universal Terrestrial Radio Access (UTRA), cdma2000, etc. UTRA includes Wideband-CDMA (W-CDMA) and other variants of CDMA. Further, cdma2000 covers IS-2000, IS-95 and IS-856 standards. A TDMA system may implement a radio technology such as Global System for Mobile Communications (GSM). An OFDMA system may implement a radio technology such as Evolved UTRA (E-UTRA), Ultra Mobile Broadband (UMB), IEEE 802.11 (Wi-Fi), IEEE 802.16 (WiMAX), IEEE 802.20, Flash-OFDM, etc. UTRA and E-UTRA are part of Universal Mobile Telecommunication System (UMTS). 3GPP Long Term Evolution (LTE) is a release of UMTS that uses E-UTRA, which employs OFDMA on the downlink and SC-FDMA on the uplink. UTRA, E-UTRA, UMTS, LTE and GSM are described in documents from an organization named "3rd Generation Partnership Project" (3GPP). Additionally, cdma2000 and UMB are described in documents from an organization named "3rd Generation Partnership Project 2" (3GPP2). Further, such wireless communication systems may additionally include peer-to-peer (e.g., mobile-to-mobile) ad hoc network systems often using unpaired unlicensed spectrums, 802.xx wireless LAN, BLUETOOTH and any other short- or long-range, wireless communication techniques.

Various aspects or features will be presented in terms of systems that may include a number of devices, components, modules, and the like. It is to be understood and appreciated that the various systems may include additional devices, components, modules, etc. and/or may not include all of the devices, components, modules etc. discussed in connection with the figures. A combination of these approaches may also be used.

The various illustrative logics, logical blocks, modules, and circuits described in connection with the aspects disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. Additionally, at least one processor may comprise one or more modules operable to perform one or more of the steps and/or actions described above.

Further, the steps and/or actions of a method or algorithm described in connection with the aspects disclosed herein may be embodied directly in hardware, in a software module executed by a processor, or in a combination of the two. A software module may reside in RAM memory, flash memory, ROM memory, EPROM memory, EEPROM memory, registers, a hard disk, a removable disk, a CD-ROM, or any other form of storage medium known in the art. An exemplary storage medium may be coupled to the processor, such that the processor can read information from, and write information to, the storage medium. In the alternative, the storage medium may be integral to the processor. Further, in some aspects, the processor and the storage medium may reside in an ASIC. Additionally, the ASIC may reside in a user terminal. In the alternative, the processor and the storage medium may reside as discrete components in a user terminal. Additionally, in some aspects, the steps and/or actions of a method or algorithm may reside as one or any combination or set of codes and/or instructions on a machine readable medium and/or computer readable medium, which may be incorporated into a computer program product.

In one or more aspects, the functions described may be implemented in hardware, software, firmware, or any combination thereof. If implemented in software, the functions may be stored or transmitted as one or more instructions or code on a computer-readable medium. Computer-readable media includes both computer storage media and communication media including any medium that facilitates transfer of a computer program from one place to another. A storage medium may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection may be termed a computer-readable medium. For example, if software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs usually reproduce data optically with lasers. Combinations of the above should also be included within the scope of computer-readable media.

While the foregoing disclosure discusses illustrative aspects and/or aspects, it should be noted that various changes and modifications could be made herein without departing from the scope of the described aspects and/or aspects as defined by the appended claims. Furthermore, although elements of the described aspects and/or aspects may be described or claimed in the singular, the plural is contemplated unless limitation to the singular is explicitly stated. Additionally, all or a portion of any aspect and/or aspect may be utilized with all or a portion of any other aspect and/or aspect, unless stated otherwise.

What is claimed is:

1. An apparatus comprising:

a receiver of a wireless communication device (WCD), the receiver configured to receive a distributed radio signal from a first service provider;

a processor coupled to the receiver, the processor configured to generate a bookmark associated with a first content item included in the distributed radio signal, wherein the bookmark is generated based on radio application data when the WCD is radio-enabled, and wherein the bookmark is generated based on pseudo-radio application data when the WCD is not radio-enabled; and a transmitter coupled to the processor, the transmitter configured to transmit the bookmark and a content request associated with the first content item to a content source.

2. The apparatus of claim 1, wherein the bookmark is generated based on metadata included in the distributed radio signal when the WCD is Radio Data System enabled.

3. The apparatus of claim 1, wherein the content source comprises the first service provider.

4. The apparatus of claim 1, wherein the content source comprises a second service provider distinct from the first service provider.

5. The apparatus of claim 1, wherein the distributed radio signal is distributed in a frequency modulation (FM) format, an amplitude modulation (AM) format, an internet protocol (IP) format, an HD radio format, or a satellite radio format.

6. The apparatus of claim 1, wherein the first service provider broadcasts, unicasts, or multicasts the distributed radio signal to the WCD.

7. The apparatus of claim 1, wherein the bookmark includes an audio clip capture of the first content item, a location identifier of the WCD, a timestamp, user input of a first content item tag, at least a portion of metadata received with the first content item, Radio Data System information for the first content item, information obtained for the first content item from a content guide, or combinations thereof.

8. The apparatus of claim 1, wherein the processor is configured to generate the bookmark in response to user input.

9. A method comprising:

receiving a distributed radio signal at a wireless communications device (WCD) from a first service provider;

generating a bookmark associated with a first content item included in the distributed radio signal, wherein the bookmark is generated based on radio application data when the WCD is radio-enabled, and wherein the bookmark is generated based on pseudo-radio application data when the WCD is not radio-enabled; and transmitting the bookmark and a content request associated with the first content item from the WCD to a content source.

10. The method of claim 9, further comprising:

before generating the bookmark, determining that the WCD is configured to utilize metadata included with the distributed radio signal; and determining that the distributed radio signal does not include the metadata.

11. The method of claim 9, wherein the bookmark is generated based on metadata included in the distributed radio signal when the WCD is Radio Data System enabled.

12. The method of claim 11, wherein the metadata includes music metadata.

13. The method of claim 9, wherein the content source comprises a second service provider distinct from the first service provider.

14. The method of claim 13, wherein the second service provider comprises a cellular network service provider, an internet service provider, or both.

15. The method of claim 9, wherein the first service provider includes a first radio station, and the content source includes a web server associated with one or more radio stations including the first radio station.

16. The method of claim 9, further comprising transmitting the bookmark to a third device, wherein the bookmark enables the third device to access the first content item.

17. A non-transitory computer-readable medium comprising instructions that, when executed by a processor of a wireless communication device (WCD), cause the processor to:

receive a distributed radio signal from a first service provider;

generate a bookmark associated with a first content item included in the distributed radio signal, wherein the bookmark is generated based on radio application data when the WCD is radio-enabled, and wherein the bookmark is generated based on pseudo-radio application data when the WCD is not radio-enabled; and transmit the bookmark and a content request associated with the first content item.

18. The non-transitory computer-readable medium of claim 17, wherein the instructions cause the processor to:

before generation of the bookmark, determine that the WCD is configured to utilize metadata included with the distributed radio signal; and determine that the distributed radio signal does not include the metadata.

19. The non-transitory computer-readable medium of claim 17, wherein the bookmark is generated based on metadata included in the distributed radio signal when the WCD is Radio Data System enabled.

20. The non-transitory computer-readable medium of claim 17, wherein the distributed radio signal is distributed in a frequency modulation (FM) format, an amplitude modulation (AM) format, an internet protocol (IP) format, an HD radio format, or a satellite radio format.

21. The non-transitory computer-readable medium of claim 17, wherein the first service provider broadcasts, unicasts, or multicasts the distributed radio signal to the WCD.

22. The non-transitory computer-readable medium of claim 17, wherein the bookmark includes an audio clip capture of the first content item, a location identifier of the WCD, a timestamp, user input of a first content item tag, at least a portion of metadata received with the first content item, Radio Data System information for the first content item, information obtained for the first content item from a content guide, or combinations thereof.

23. The non-transitory computer-readable medium of claim 17, wherein the instructions are further executable by the processor to receive a second content item from the content source, wherein the second content item is associated with the first content item.

24. The non-transitory computer-readable medium of claim 17, wherein the second content item comprises a content guide associated with the first content provider.

25. An apparatus comprising:

means for receiving a distributed radio signal at a wireless communication device (WCD) from a first content source;

means for generating a bookmark associated with a first content item included in the distributed radio signal, wherein the bookmark is generated based on radio application data when the WCD is radio-enabled, and wherein the bookmark is generated based on pseudo-radio application data when the WCD is not radio-enabled; and means for transmitting the bookmark and a content request associated with the first content item from the WCD to a content source.

26. The apparatus of claim 25, further comprising means for receiving a second content item associated with the first content item in response to transmittal of the bookmark and the content request to the content source.

27. The apparatus of claim 26, wherein the second content item includes a version of the first content item.

28. The apparatus of claim 26, wherein the second content item includes a content guide associated with the first content source.

29. The apparatus of claim 25, wherein the bookmark is generated based on metadata included in the distributed radio signal when the WCD is Radio Data System enabled.

30. The apparatus of claim 25, further comprising means for receiving user input, wherein the means for generating the bookmark is utilized in response to particular user input received via the means for receiving user input.

* * * * *